US005741092A

United States Patent [19]

Castle et al.

[11] Patent Number: 5,741,092

[45] Date of Patent: Apr. 21, 1998

[54] CABLE BOLT DRIVER

[75] Inventors: Brian R. Castle, Rolla, Mo.; John C. Stankus, Canonsburg; John G. Oldsen, Butler, both of Pa.

[73] Assignee: Jennmar Corporation, Pittsburgh, Pa.

[21] Appl. No.: 601,991

[22] Filed: Feb. 15, 1996

[51] Int. Cl.[6] ..... E21D 20/00

[52] U.S. Cl. ..... 405/302; 405/259.1; 405/288; 405/259.6

[58] Field of Search ..... 405/259.1–259.6, 405/288, 302.1, 302.2

[56] References Cited

U.S. PATENT DOCUMENTS

| | | | |
|---|---|---|---|
| 1,282,028 | 10/1918 | Bellows . | |
| 3,077,809 | 2/1963 | Harding et al. . | |
| 3,226,934 | 1/1966 | Emery . | |
| 3,696,599 | 10/1972 | Palmer et al. | 57/1 UN |
| 4,150,473 | 4/1979 | Dietrich | 29/461 |
| 4,265,571 | 5/1981 | Scott | 405/259 |
| 4,469,756 | 9/1984 | Jungwirth et al. | 428/592 |
| 4,798,501 | 1/1989 | Spies | 405/260 |
| 5,189,749 | 3/1993 | Thomas et al. | 7/138 |
| 5,230,589 | 7/1993 | Gillespie | 405/259.6 |
| 5,253,960 | 10/1993 | Scott | 405/302.2 |
| 5,259,426 | 11/1993 | Burleigh et al. | 141/98 |
| 5,259,703 | 11/1993 | Gillespie | 405/259.6 |
| 5,375,946 | 12/1994 | Locotos | 405/259.4 |
| 5,378,087 | 1/1995 | Locotos | 405/259.5 |
| 5,417,521 | 5/1995 | Scott | 405/259.6 |
| 5,458,442 | 10/1995 | Ashmore | 105/302.2 |
| 5,511,909 | 4/1996 | Calandra et al. | 405/302.2 X |

FOREIGN PATENT DOCUMENTS

WO93/03256 2/1993 WIPO .

*Primary Examiner*—Dennis L. Taylor

*Attorney, Agent, or Firm*—Webb Ziesenheim Bruening Logsdon Orkin & Hanson, P.C.

[57] ABSTRACT

A cable mine roof bolt driver is disclosed for rotating a cable mine roof bolt in resin grouted applications. The bolt driver includes a body having a front face and a rear face. A cable receiving bore is positioned within the body extending into the body from the front face. The cable receiving bore is adapted to receive a cable of the cable mine roof bolt therein. A cable engaging device is provided within the cable receiving bore for rotatably engaging the cable such that rotation of the body will rotate the mine roof bolt when the cable engaging device has engaged the cable. A body rotation mechanism is coupled to the body for providing rotation of the body of the bolt driver. The cable mine roof bolt driver of the present invention can be utilized to rotate conventional cable mine roof bolts in resin grouted applications.

20 Claims, 4 Drawing Sheets

CABLE BOLT DRIVER

BACKGROUND OF THE INVENTION

1. Field of the Invention

The present invention relates to cable mine roof bolting systems including a cable mine bolt driver for rotating the cable mine roof bolt during installation in resin grouted applications.

2. Background Information

Cable systems and cable mine roof bolts have been utilized in the mining industry and the construction industry since the 1970s in cement grouted applications. These cable systems generally include a shank formed of a multi-strand cable and a barrel and wedge assembly secured to the cable to provide the necessary support after tensioning or to support the bearing plate of the mine roof bolt assembly. The barrel and wedge assembly includes a tubular barrel with a plurality of locking wedges positioned within the barrel surrounding the cable securing the barrel and wedge assembly to the cable.

Recently, cable mine roof bolts have been utilized in resin grouted applications. In resin grouted applications, the mine roof bolt is rotated to mix the resin during installation. Examples of cable mine roof bolts designed for resin grouted applications can be found in U.S. Pat. Nos. 5,230,589; 5,259,703 and 5,375,946. All of these prior art patents disclose specialized resin grouted mine roof bolts. Each of these prior art designs replaces the conventional barrel and wedge assembly with a distinct drive head.

An object of the present invention is to provide a cable mine roof bolting system for both cement and resin grouted applications which utilize conventional cable and barrel and wedge assemblies. A further object of the present invention is to provide a cable mine roof bolt driver for rotating a conventional mine roof bolt in resin grouted applications. Another object of the present invention is to provide an effective cable mine roof bolt driver which is easy to manufacture.

SUMMARY OF THE INVENTION

The objects of the present invention are achieved by providing a cable mine roof bolt driver which includes a body having a front and rear face. A cable receiving bore is positioned within the body extending into the body from the front face. The cable receiving bore is adapted to receive a cable of a cable mine roof bolt therein. A cable engaging device is positioned within the cable receiving bore for rotatably engaging the cable, wherein rotation of the body will rotate the mine roof bolt when the cable engaging device is engaging the cable. A body rotation mechanism is coupled to the body for providing rotation of the body.

In one embodiment of the present invention, the cable engaging device is formed by six engaging faces which define the cable receiving bore. Each engaging face may be substantially planar such that the cable receiving bore has a hexagonal perimeter. The hexagonal perimeter of the cable receiving bore is adapted to receive and engage the six perimeter strands of a standard seven-strand cable.

In a second embodiment of the present invention, the cable engaging device is formed by a plurality of projections extending from the peripheral surface of the cable receiving bore. Each projection is adapted to be received between adjacent peripheral strands of the cable. In the second embodiment of the present invention, each projection may be positioned at an angle relative to the longitudinal axis of the cable receiving bore with the angle of the projection substantially matching the lay of the strands on the cable. Preferably, six projections would be utilized which will correspond with the conventional seven-strand cable having six peripheral helically wound strands.

In a third embodiment of the present invention, the cable receiving bore is formed by three intersecting slots extending into the front face of the body. The intersecting slots also form a plurality of projections within the cable receiving bore with these projections forming the cable engaging device. Each projection is adapted to be received between adjacent peripheral strands of the cable.

The present invention may additionally include an annular locating ring extending forwardly of the front face of the body. The annular locating ring is adapted to receive a barrel and wedge assembly therein to locate the mine roof bolt driver on the cable mine roof bolt.

The body rotation mechanism may be formed of a drive bore of substantially polygonal cross section extending into the body from the rear face with the drive bore which is adapted to receive and engage a drive shaft therein.

The cable mine roof bolt driver of the present invention may be utilized with a plurality of conventional cable mine roof bolts to provide a cable mine roof bolting system which may be used both in resin grouting and cement grouting applications. The conventional cable mine roof bolt generally includes a multi-strand cable having a central strand and six peripheral strands helically wound around the central strand and a barrel and wedge assembly attached to the multi-strand cable for supporting appropriate bearing plates.

In operation, the cable mine roof bolt driver of the present invention is utilized for installing resin grouted cable mine roof bolts. The cable mine roof bolt and an appropriate resin are inserted into a pre-drilled bore hole. The cable mine roof bolt is engaged with the cable mine roof bolt driver of the present invention. The cable mine roof bolt driver is rotated to cause rotation of the cable mine roof bolt and appropriate mixing of the resin. The resin is allowed to cure and the process may be repeated for subsequent cable mine roof bolts.

These and other advantages of the present invention will be clarified in the description of the preferred embodiments wherein like reference numerals represent like elements throughout.

BRIEF DESCRIPTION OF THE PREFERRED EMBODIMENTS

Figure 1:
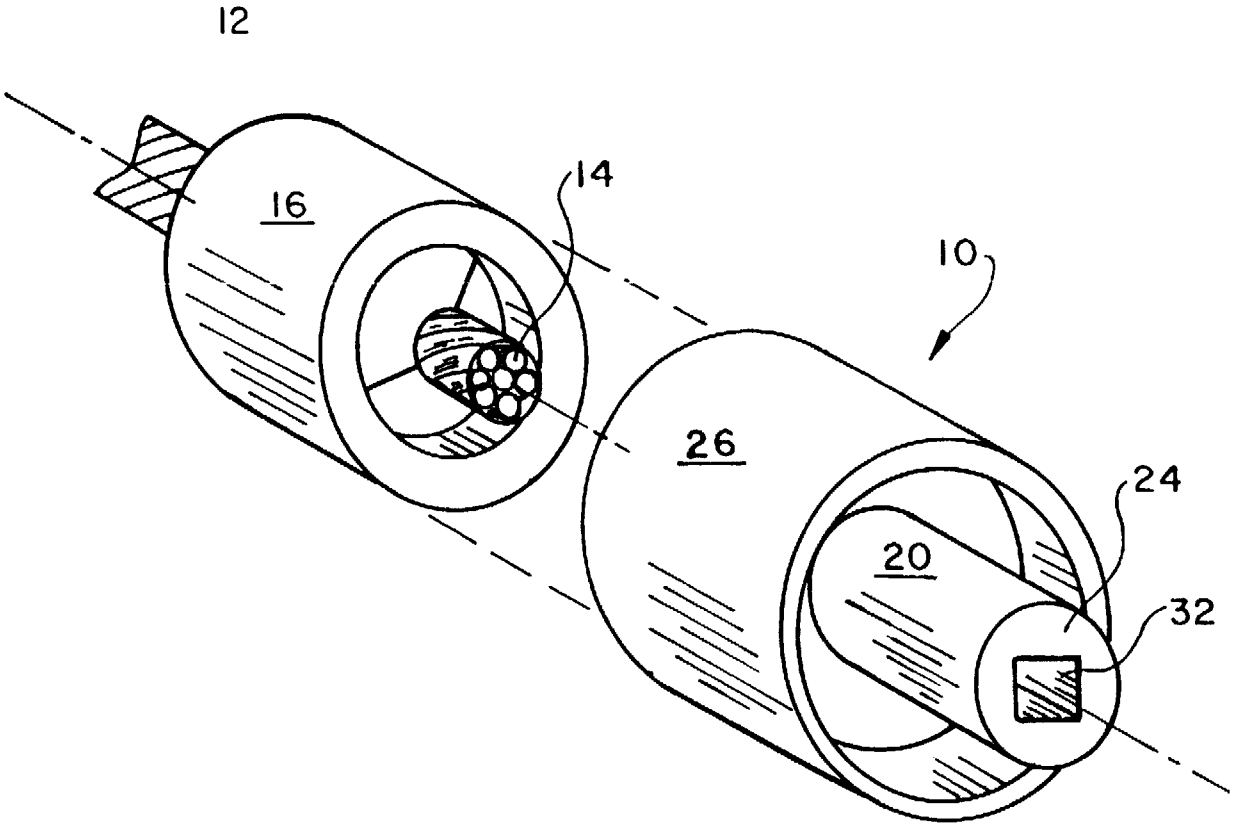
FIG. 1 is an exploded side view of a cable mine roof bolt driver and an associated cable mine roof bolt according to a first embodiment of the present invention.
Figure 2:
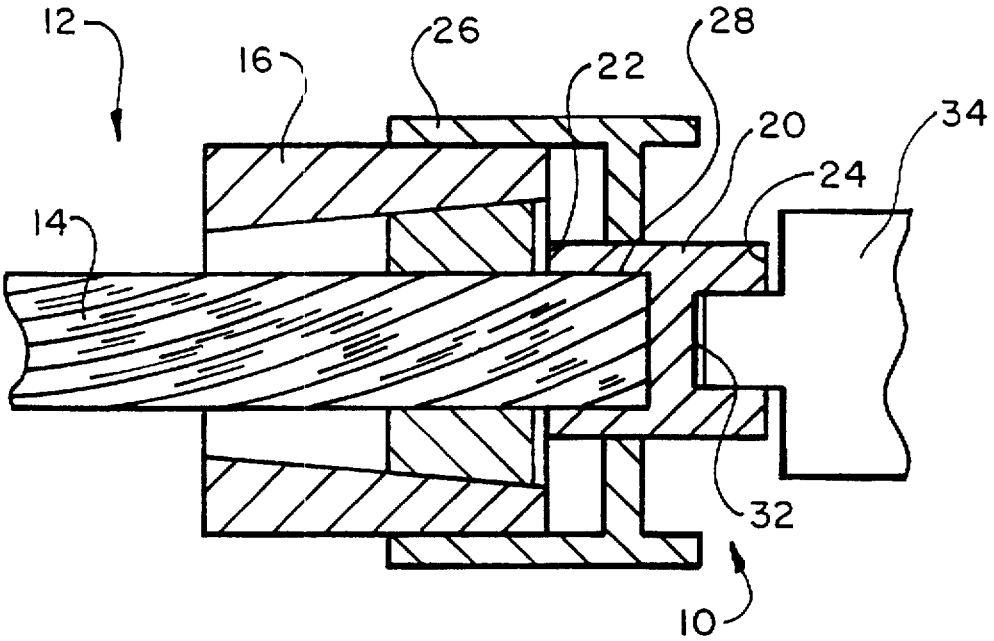
FIG. 2 is a sectional side view of the cable mine roof bolt driver illustrated in FIG. 1.
Figure 3:
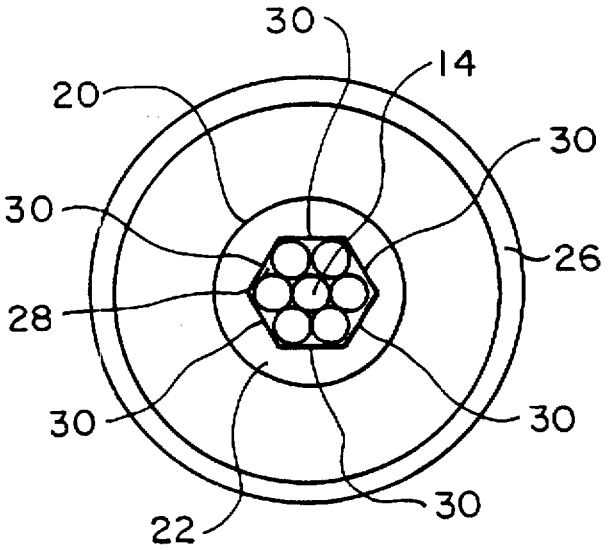
FIG. 3 is a sectional end view of the cable mine roof bolt driver illustrated in FIG. 1.

FIGS. 1–3 illustrate a cable mine roof bolt driver 10 according to a first embodiment of the present invention.

The bolt driver 10 is adapted to engage and rotate a conventional cable mine roof bolt 12 during installation in a resin grouted application as described below. The conventional cable mine roof bolt 12 includes a shank formed of a multi-strand cable 14. Multi-strand cable 14 is generally a seven-strand steel cable formed of a central strand having six peripheral outer strands helically wound tightly around the central strand. The typical cable 14 is defined in ASTM designation A 416 entitled "Standard Specification for Steel Strand, Uncoated Seven-Wire for Prestressed Concrete", and a galvanized cable is defined in ASTM designation A 586. A conventional cable mine roof bolt 12 may include a conventional barrel and wedge assembly 16 having a tubular barrel and plurality of locking wedges and positioned within the tubular barrel and surrounding the cable 14 for securing the barrel and wedge assembly 16 to the cable 14.

The bolt driver 10 includes a substantially cylindrical body 20 having a front face 22 and a rear face 24. An annular locating ring 26 extends forwardly of the front face 22 away from the body 20. The annular locating ring 26 is adapted to receive the barrel and wedge assembly 16 therein to center the bolt driver 10 on the cable mine roof bolt 12. The annular locating ring 26 may be formed integral or separate from the body 20.

The bolt driver 10 includes a cable receiving bore 28 extending into the body 20 from the front face 22. The cable receiving bore 28 is a substantially hexagonal bore formed by six substantially planar engaging faces 30. As shown in FIG. 3, the cable 14 is received within the cable receiving bore 28 wherein the engaging faces 30 abut the six strands of the cable 14 and wherein rotation of the body 20 will rotate the cable 14.

The bolt driver 10 includes a drive bore 32 extending into the body 20 from the rear face 24. The drive bore 32 has a polygonal cross section, such as a square or hexagonal cross section, wherein the drive bore 32 receives and is rotatably coupled to a drive shaft 34. Rotation of the drive shaft 34 will rotate the body 20 and a cable 14 when the cable 14 is received within the cable receiving bore 28. Drive shaft 34 may also be made integral with the body 20. A further alternative is to utilize an external drive for the bolt driver 10 rather than the internal drive formed by drive bore 32. For example, a square driving head may be attached to the rear of body 20.

In operation, the bolt driver 10 is used to rotate the cable mine roof bolt 12 in resin grouted applications. The cable mine roof bolt 12 and conventional resin (not shown) is inserted into the drilled bore hole. The barrel and wedge assembly 16 is positioned outside of the bore hole supporting an appropriate bearing plate as is well known in the art. The bolt driver 10 is inserted onto the cable mine roof bolt 12 with the barrel and wedge assembly 16 received within the annular locating ring 26 and the cable 14 is received within the cable receiving bore 28. Bolt driver 10 is rotated by rotation of the drive shaft 34 to rotate the cable mine roof bolt 12 to rupture and mix the resin. The drive shaft 34 is preferably driven by appropriate bolting machinery. Following rotation, the resin is allowed to cure, the bolt driver 10 is removed and the process can be repeated for subsequent resin grouted cable mine roof bolts 12. Cable mine roof bolt 12 can be utilized in cement grouting applications in a conventional fashion.

Figure 4:
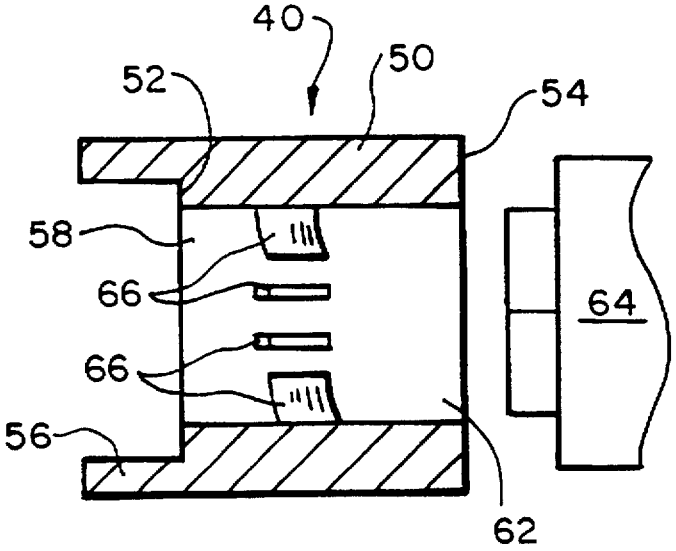
FIG. 4 is a sectional side view of a cable mine roof bolt driver according to a second embodiment of the present invention.
Figure 5:
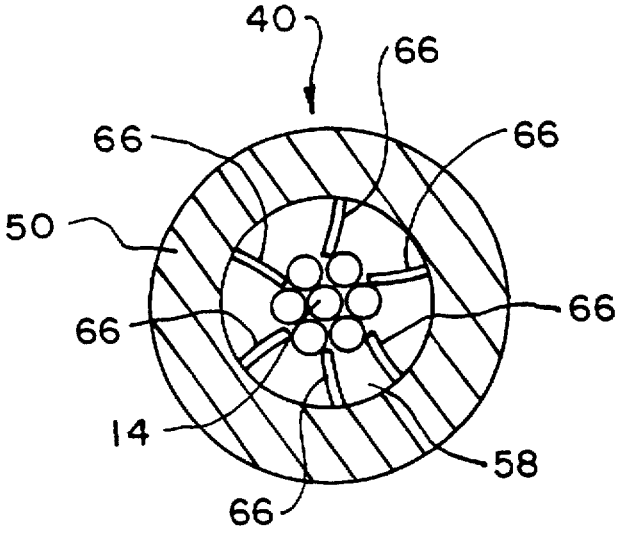
FIG. 5 is a sectional end view of the cable mine roof bolt driver illustrated in FIG. 4.

FIGS. 4 and 5 illustrate a cable mine roof bolt driver 40 according to a second embodiment of the present invention. The bolt driver 40 is substantially similar to the bolt driver 10 described above. The bolt driver 40 includes a body 50 with a front face 52 and a rear face 54, an annular locating ring 56 extending from the front face 52, a cable receiving bore 58, a drive bore 62 and drive shaft 64, all substantially the same as described above in connection with bolt driver 10.

The bolt driver 40 differs from the bolt driver 10 by replacing the planar engaging faces 30 with six projections 66 extending inwardly from the peripheral side of the substantially circular cable receiving bore 58. Each projection 66 is adapted to be received between adjacent outer peripheral strands of the cable 14 to engage and rotate the cable 14 as illustrated in FIG. 5. Each projection 66 is preferably angled relative to the longitudinal axis of the receiving bore so that the angle of each projection 66 substantially matches the lay of the six outer strands of the cable 14. In operation, the bolt driver 40 is utilized substantially the same as the bolt driver 10 described above. Alternatively, the projections 66 may be formed as points which would achieve the rotational aspects of the projections 66. The points may have less working life than the angled projections 66 shown in FIGS. 4 and 5, but would not have to be angled to match the lay of the cables. Further, although six projections 66 are preferred, the bolt driver 40 may effectively function with less than six projections 66.

Figure 6:
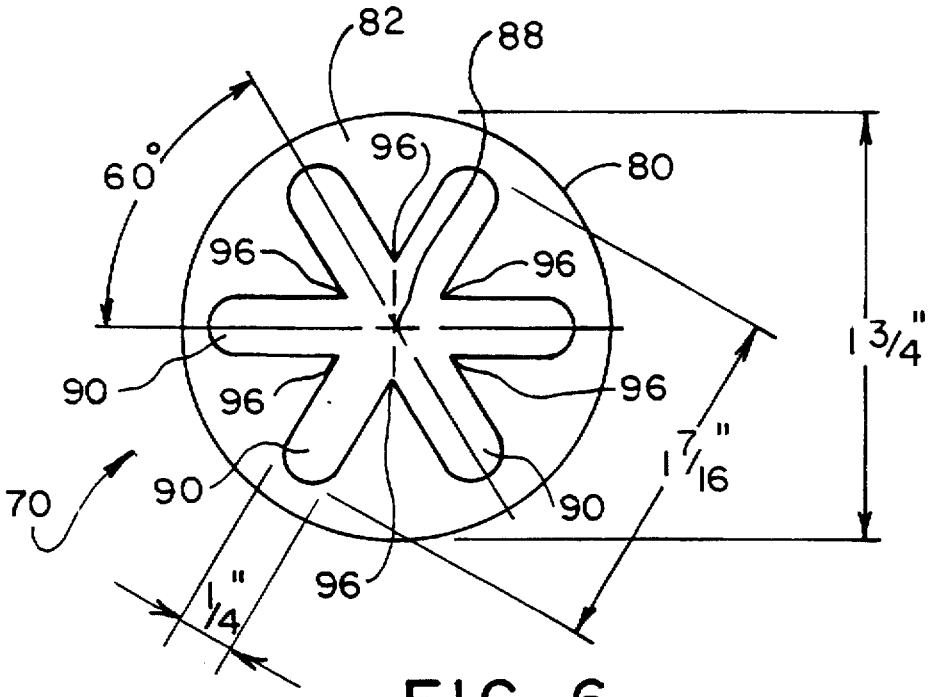
FIG. 6 is an end view of a cable mine roof bolt driver according to a third embodiment of the present invention.
Figure 7:
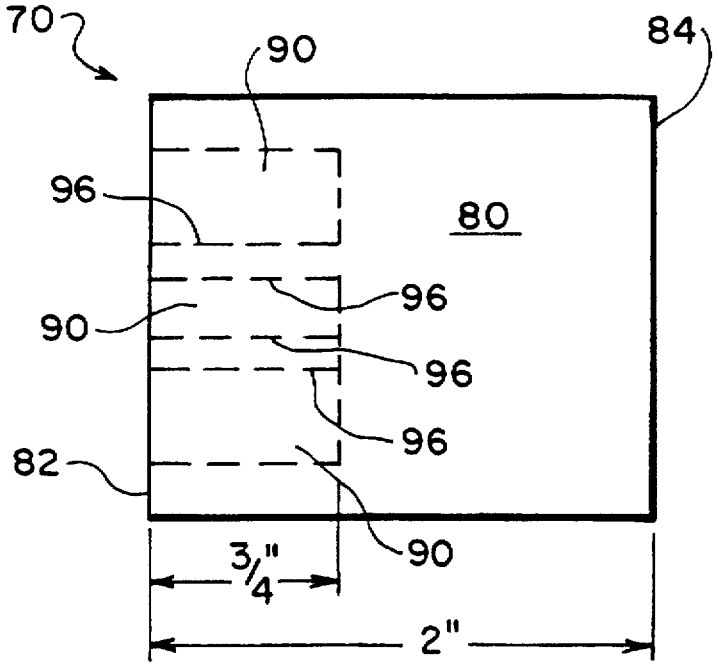
FIG. 7 is a side view of the cable mine roof bolt driver illustrated in FIG. 6.

FIGS. 6 and 7 illustrate a cable mine roof bolt driver 70 according to a third embodiment of the present invention. The bolt driver 70 is substantially similar to the bolt drivers 10 and 40 described above. The bolt driver 70 includes a body 80 with a front face 82 and rear face 84. An annular locating ring (not shown) may be provided to extend from the front face 82 substantially the same as annular locating rings 26 and 56 described above. A cable receiving bore 88 is formed in the body 80 extending in from the front face 82. The bolt driver 70 will additionally include appropriate means for being driven such as an internal drive bore extending into the rear face 84 or external planar drive faces formed on the exterior of the body 80 around the rear face 84.

The bolt driver 70 differs from the bolt drivers 10 and 40 in the manner in which the cable receiving bore 88 is formed. The cable receiving bore 88 is formed by three intersecting slots 90. In a body 80 of a diameter of about 1¾" and length of about 2", the slots 90 may be formed by milling with a length of about 1 7/16", a width of about ¼", a depth of about ¾" and offset from each other by 60°. Of course, the specific dimensions of the bolt driver 70 may be varied depending upon the application. The formation of the cable receiving bore 88 by three intersecting slots 90 forms six projections 96 within the cable receiving bore 88. Each projection 96 is adapted to be received between adjacent outer peripheral strands of the cable 14 to engage and rotate the cable 14. In this manner, the projections 96 operate substantially the same as angled projections 66 discussed above. Therefore, in operation, the bolt driver 70 is utilized substantially the same as bolt drivers 10 and 40 discussed above.

The bolt drivers 10, 40 and 70 of the present invention allow conventional mine roof bolts 12 to be utilized in both cement and resin grouting applications without the need for a specialized drive head to be incorporated onto the cable mine roof bolt 12. The bolt drivers 10 and 40 of the present invention can be easily operated with conventional bolting equipment.

It will be apparent to those of ordinary skill in the art that various changes and modifications may be made to the present invention without departing from the spirit and scope thereof. Consequently, the scope of the present invention is intended to be defined by the attached claims.

What is claimed is:

1. A cable mine roof bolt driver for driving cable mine roof bolts, said cable mine roof bolt driver comprising:

a) a body having a front face and a rear face;

b) a cable receiving bore within said body extending into said body from said front face and adapted to releasably receive a cable of a cable mine roof bolt therein;

c) a cable engaging means within said cable receiving bore for releasably, directly, rotatably engaging the cable, wherein rotation of said body will rotate the mine roof bolt when said cable engaging means is directly engaging the cable; and d) a body rotation means coupled to said body for providing rotation of said body.

2. The cable mine roof bolt driver of claim 1 wherein said cable engaging means includes a plurality of engaging faces which defines said cable receiving bore.

3. The cable mine roof bolt driver of claim 2 wherein six said engaging faces are provided.

4. The cable mine roof bolt driver of claim 3 wherein each said engaging face is substantially planar, whereby said cable receiving bore has a hexagonal perimeter.

5. A cable mine roof bolt driver comprising:

a) a body having a front face and rear face;

b) a cable receiving bore within said body extending into said body from said front face and adapted to receive a cable mine roof bolt therein;

c) a cable engaging means within said cable receiving bore for rotatably engaging the cable, wherein rotation of said body will rotate the mine roof bolt when said cable engaging means is engaging the cable;

d) an annular locating ring coupled to said body and extending forwardly of said front face of said body, said annular locating ring adapted to receive a barrel and wedge assembly of the cable mine roof bolt therein; and e) a body rotation means coupled to said body for providing rotation of said body.

6. The cable mine roof bolt driver of claim 5 wherein said cable engaging means includes a plurality of engaging faces which defines said cable receiving bore.

7. The cable mine roof bolt driver of claim 6 wherein six said engaging faces are provided.

8. The cable mine roof bolt driver of claim 7 wherein each said engaging face is substantially planar, whereby said cable receiving bore has a hexagonal perimeter.

9. The cable mine roof bolt driver of claim 5 wherein said cable engaging means comprises a plurality of projections extending inwardly within said cable receiving bore, each said projection adapted to be received between adjacent outer strands of the cable.

10. The cable mine roof bolt driver of claim 9 wherein each said projection is positioned at an angle relative to the longitudinal axis of said cable receiving bore.

11. The cable mine roof bolt driver of claim 9 wherein said cable receiving bore and said projections are formed by three intersecting slots extending into said body from said front face.

12. The cable mine roof bolt driver of claim 9 wherein six said projections are provided.

13. A cable mine roof bolt driver comprising:

a) a body having a front face and a rear face;

b) a cable receiving bore within said body extending into said body from said front face and adapted to receive a cable of a mine roof bolt therein;

c) a cable engaging means within said cable receiving bore for rotatably engaging the cable, wherein rotation of said body will rotate the mine roof bolt when said cable engaging means is engaging the cable, wherein said cable engaging means comprises a plurality of projections extending inwardly within said cable receiving bore, each said projection adapted to be received between adjacent strands of the cable; and d) a body rotation means coupled to said body for providing rotation of said body.

14. The cable mine roof bolt driver of claim 13 wherein each said projection is positioned at an angle relative to the longitudinal axis of said cable receiving bore.

15. The cable mine roof bolt driver of claim 13 wherein said cable receiving bore and each said projection are formed by a plurality of intersecting slots extending into said body from said front face.

16. The cable mine roof bolt driver of claim 1 wherein said body rotation means includes a drive bore substantially polygonal in cross section extending into said body from said rear face, said drive bore adapted to receive and engage a drive shaft therein.

17. A cable mine roof bolt system comprising:

at least one cable mine roof bolt, each said cable mine roof bolt including a multi-strand cable and a barrel and wedge assembly attached to said multi-strand cable; and a cable mine roof bolt driver removably coupled to said at least one cable mine roof bolt for rotating each said mine roof bolt, each said driver including i) a body having a front and rear face, ii) a cable receiving bore within said body extending into said body from said front face and adapted to receive said multi-strand cable of each said cable mine roof bolt therein, and iii) a cable engaging means within said cable receiving bore for releasably, directly, rotatably engaging said multi-strand cable, wherein rotation of said body will rotate the mine roof bolt when said cable engaging means is directly engaging said cable.

18. The cable mine roof bolt system of claim 17 wherein each said multi-strand cable includes a central strand and six peripheral strands helically wound around said central strand.

19. The cable mine roof bolt system of claim 17 wherein said bolt driver further includes an annular locating ring coupled to said body and extending forwardly of said front face of said body, said annular locating ring adapted to receive said barrel and wedge assembly of each said cable mine roof bolt therein.

20. A method of installing resin grouted cable mine roof bolts wherein each said cable mine roof bolt includes a multi-strand cable and a barrel and wedge assembly attached to said multi-strand cable, said method comprising the steps of:

a) inserting a cable mine roof bolt and resin into a pre-drilled bore hole;

b) directly engaging said multi-strand cable of said cable mine roof bolt with a cable mine roof bolt driver, said mine roof bolt driver including i) a body having a front face and a rear face, ii) a cable receiving bore within said body extending into said body from said front face and adapted to receive said cable of each said cable mine roof bolt therein, and iii) a cable engaging means within said cable receiving bore for releasably, directly, rotatably engaging said cable wherein rotation of said body will rotate said mine roof bolt when said cable engaging means is directly engaging said cable;

c) rotating said cable mine roof bolt driver and said mine roof bolt to mix said resin; and d) allowing said resin to cure and removing said cable mine roof bolt driver from said cable mine roof bolt.

* * * * *